US006796066B2

(12) United States Patent
Champnella, II

(10) Patent No.: US 6,796,066 B2
(45) Date of Patent: Sep. 28, 2004

(54) DISPLAY DEVICE

(76) Inventor: Frederic E. Champnella, II, 24537 Martel, Farmington Hills, MI (US) 48335

( * ) Notice: Subject to any disclaimer, the term of this patent is extended or adjusted under 35 U.S.C. 154(b) by 0 days.

(21) Appl. No.: 10/403,663

(22) Filed: Mar. 31, 2003

(65) Prior Publication Data

US 2003/0217498 A1 Nov. 27, 2003

Related U.S. Application Data

(60) Provisional application No. 60/369,834, filed on Apr. 4, 2002.

(51) Int. Cl.[7] ..... A47G 1/06

(52) U.S. Cl. ..... 40/735; 40/765; 40/768; 40/771; 40/775; 40/776

(58) Field of Search ..... 40/700, 735, 743, 40/765, 766, 768, 770, 771, 775, 776

(56) References Cited

U.S. PATENT DOCUMENTS 2,858,629 A * 11/1958 Carter ..... 40/735
3,813,799 A * 6/1974 Caravello ..... 40/735
4,424,637 A * 1/1984 Leahy ..... 40/735
4,794,714 A * 1/1989 Weisgerber ..... 40/735
4,899,473 A * 2/1990 Wiener ..... 40/735
5,349,770 A * 9/1994 Bursey et al. ..... 40/735
6,132,283 A * 10/2000 O'Donnell et al. ..... 40/735
6,536,149 B1 * 3/2003 Phillips ..... 40/768

* cited by examiner

*Primary Examiner*—Gary C. Hoge
(74) *Attorney, Agent, or Firm*—Gifford, Krass, Groh, Sprinkle, Anderson & Citkowski, P.C.

(57) ABSTRACT

A display device for displaying flat articles. The device includes a frame having a front side and a rear side. A transparent sheet is mounted to the frame at its front side. A planar mat having a plurality of cutouts in predefined shapes and at predefined positions is then positioned flatly against the transparent sheet. Thereafter, a planar article holder having a plurality of pockets wherein each pocket corresponds in shape and location to an associated cutout in the mat, is then positioned flatly against the planar mat. Each pocket is designed to hold one flat article for display. A planar backing is then mounted to the frame adjacent the rear side of the frame so that the mat and article holder are sandwiched in between the transparent sheet and the backing.

19 Claims, 3 Drawing Sheets

DISPLAY DEVICE

RELATED APPLICATION

This application claims priority of U.S. Provisional Patent Application Ser. No. 60/369,834 filed Apr. 4, 2002, which is incorporated herein by reference.

BACKGROUND OF THE INVENTION

I. Field of the Invention

The present invention relates generally to display devices and, more particularly, to such a device for displaying flat articles.

II. Description of Related Art

There have been many previously known devices for displaying flat articles, such as photographs. Typically, these display devices comprise a frame having a front side and a rear side. A transparent sheet is mounted within the frame at its front side while a mat with a cutout is then positioned flatly against the transparent sheet. The flat item to be displayed is then mounted within the frame and positioned with taping to maintain alignment with the mat cutout so that the article to be displayed is visible through the mat and the transparent sheet. A rigid or semi-rigid backing is then provided across the back of the frame in order to complete the assembly of the display device.

A primary disadvantage of these previously known display devices, however, is that the mat typically includes a single cutout so that only a single planar article can be displayed by the display device. Furthermore, since the article to be displayed will vary in size, it is necessary with these previously known frames to individually cut the mat so that the size of the cutout in the mat corresponds to the shape and size of the article to be displayed. This, however, is disadvantageously labor intensive and, thus, expensive.

The greatest disadvantage to all such devices, however, is that each planar article must be carefully adhered to the underside of the mat opening by tape. Any replacement or subsequent repositioning of the displayed article necessitates removal of the tape from the article and the mat board, prompting possible damage to both the mat board and/or the displayed article.

SUMMARY OF THE PRESENT INVENTION

The present invention provides a display device for displaying a plurality of planar articles, such as photographs, pennants, and the like, which overcomes all of the above-mentioned disadvantages of the previously known devices.

In brief, the display device of the present invention comprises a frame having a front side and a rear side. Preferably, the frame is rectangular in shape, although other shapes may alternatively be used.

A transparent sheet is mounted within the frame adjacent its front side. This transparent sheet may be constructed of glass, transparent plastic or the like.

A planar mat is then positioned flatly against the transparent sheet within the frame. This planar mat includes a plurality of cutouts in predefined shapes and at predefined locations along the mat.

A planar article holder having a plurality of pockets is then positioned flatly against and behind the planar mat. The article holder is preferably constructed of transparent plastic, vinyl or the like and each pocket in the article holder corresponds in shape, size and location to a single associated cutout in the mat. Consequently, with the article holder positioned within the frame behind the mat, one pocket is aligned with each of the cutouts in the mat and each of these pockets is of substantially the same size and shape as its associated mat cutout.

Planar articles, such as pennants, photographs and the like, are then positioned within the various pockets in the article holder. In doing so, the planar mat properly positions these planar articles to be displayed with the cutouts in the mat so that the articles to be displayed are visible through the transparent sheet. The article holder, furthermore, retains the articles to be displayed properly positioned without the need for adhesive or the like. Moreover, if desired, the articles to be displayed may be easily removed and replaced with different articles to be displayed.

After the articles to be displayed are positioned within the various pockets of the article holder, a rigid backing is then mounted adjacent the rear end of the frame so that the mat, article holder, as well as the articles to be displayed, are sandwiched in between the backing and the transparent sheet. This backing, furthermore, is preferably hingedly secured to the frame to facilitate not only the assembly of the frame with the articles to be displayed, but also to facilitate access to the article holder in the event that new or different articles are to be displayed within the same display assembly.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
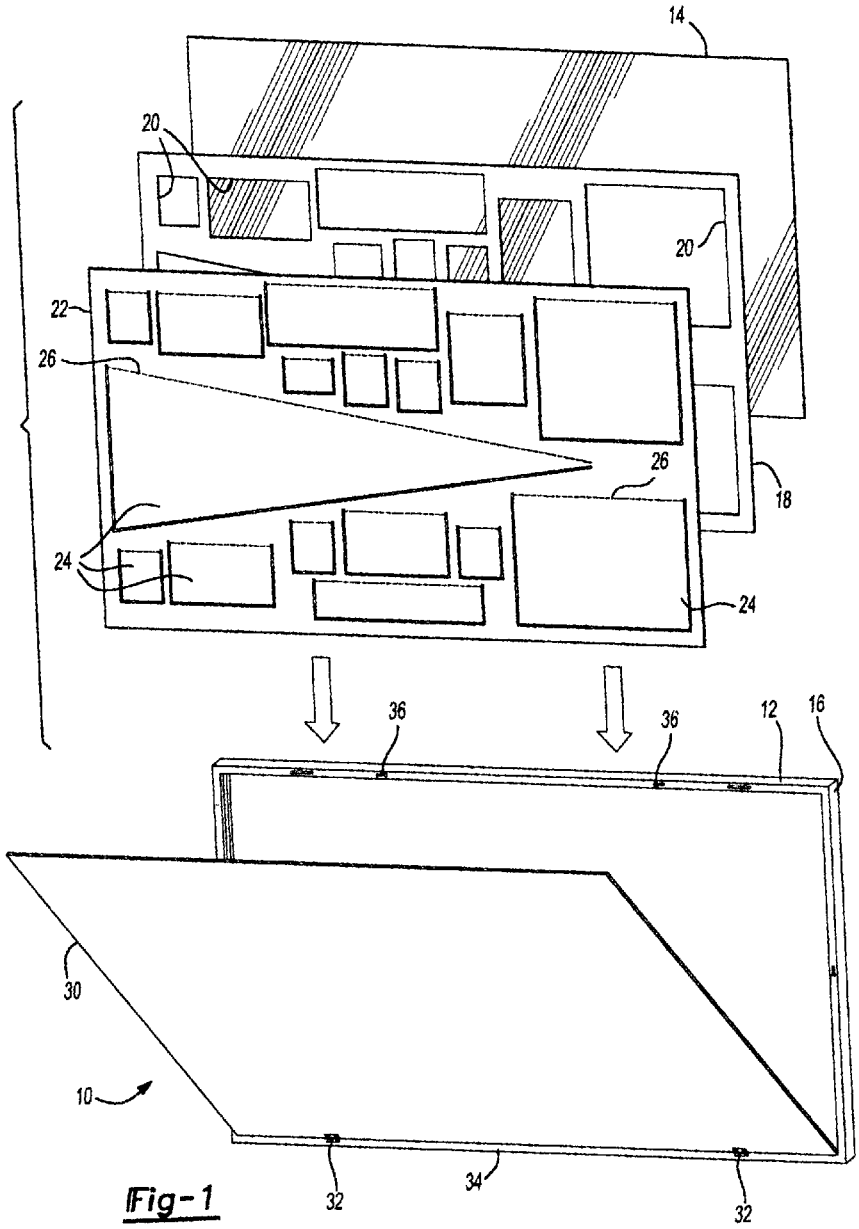
FIG. 1 is an exploded elevational view illustrating a preferred embodiment of the present invention.

With reference first to FIG. 1, an exploded view of a preferred embodiment of the display device 10 of the present invention is shown and comprises a frame 12. Preferably, the frame 12 is constructed of metal, wood or other rigid material. Furthermore, although the frame 12 illustrated in FIG. 1 is rectangular in shape, it will be understood that the frame 12 may be of other shapes without deviation from either the spirit or the scope of the invention.

Still referring to FIG. 1, a transparent sheet 14 is mounted within the interior of the frame 12 so that the sheet 14 is adjacent a front side 16 of the frame 12. The transparent sheet may be constructed of glass, clear plastic or the like.

Still referring to FIG. 1, a mat 18 is then positioned within the frame 12 so that the mat 18 flatly abuts against the transparent sheet 14. The mat 18, furthermore, includes a plurality of cutouts 20 and each cutout 20 is at a predetermined position on the mat 18 and is of a predetermined size. The mat 18 may be constructed of any desired opaque material, such as a cardboard material.

Figure 2:
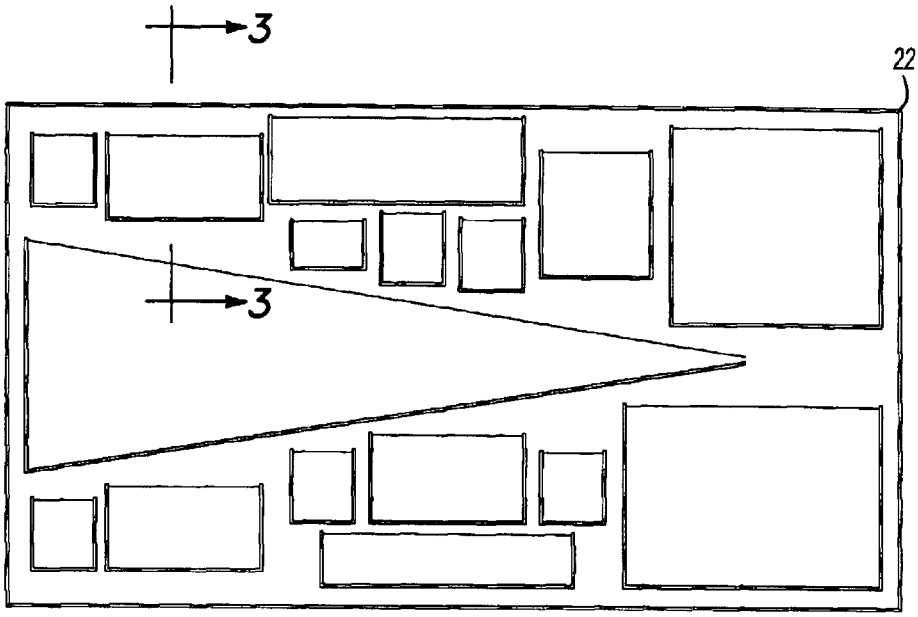
FIG. 2 is a plan view of the article holder used with the display device of the present invention.
Figure 3:
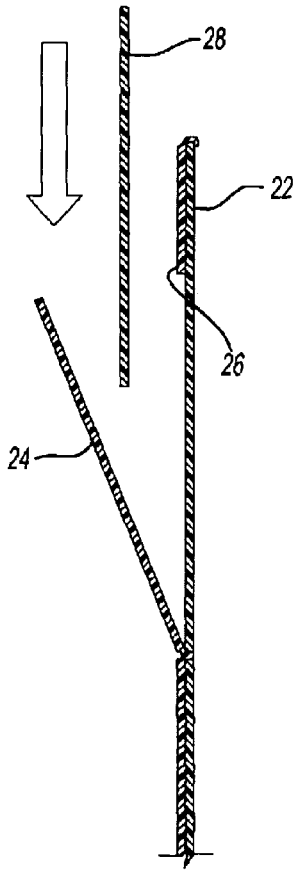
FIG. 3 is a fragmentary sectional view taken substantially along line 3—3 in FIG. 2 and enlarged for clarity.

With reference now to FIGS. 1–3, a planar article holder 22 is then positioned within the frame 12 so that the article holder 22 flatly abuts against a rear side of the mat 18. The article holder 22 is preferably constructed of a plastic, vinyl or the like material and includes a plurality of pockets 24 wherein each pocket 24 has an open top 26. Consequently, as best shown in FIG. 3, a planar article 28 to be displayed, such as a photograph or a pennant, may be positioned within each pocket 24 by inserting the article 28 through the open top 26 of the pocket 24.

Still referring to FIGS. 1–3, each pocket 24 corresponds in both shape and location to one of the cutouts 20 in the mat 18. Consequently, with the article holder 22 positioned flatly against the mat 18, each pocket 24 is not only of the same shape and size as its associated cutout 20 in the mat 18, but is also aligned with its associated cutout 20. Thus, when the articles 28 to be displayed are positioned within their respective pockets 24 on the article holder 22, these articles 28 will all be properly aligned and visible through both the mat 18 and transparent sheet 24.

Preferably the article holder 22 is constructed of a flexible, transparent plastic, vinyl or the like material. However, at the very least, the front surface of each pocket 24 of the article holder 22 is transparent.

After the transparent sheet 14, mat 18 and article holder 22 are positioned within the frame 12, a rigid backing 30 (FIG. 1) is then secured to the frame 12 so that the mat 18 and article holder 22 are sandwiched in between the transparent sheet 14 and backing 30. Preferably, the backing 30 is secured to the frame 12 by hinges 32 along one side 34 of the backing 30. With the backing 30 in its closed position, i.e. with the backing 30 flatly abutting against the article holder 22, the backing 30 is then secured in position to the frame 12 by one or more turn buttons 36. Furthermore, the hinged connection of the backing 30 to the frame 12 facilitates constant display device alignment, the rapid assembly of the display device 10, and also facilitates access to the article holder 22 for repeated replacement or substitution of the various articles 28 which are displayed by the display device 10.

Figure 4:
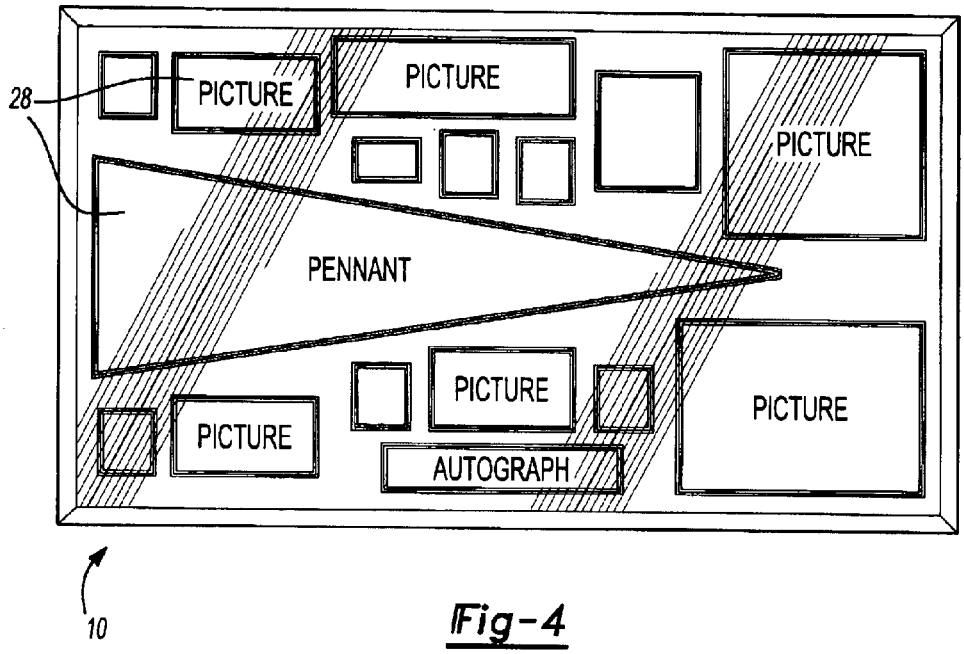
FIG. 4 is a front plan view of the completed display device of the present invention.
Figure 5:
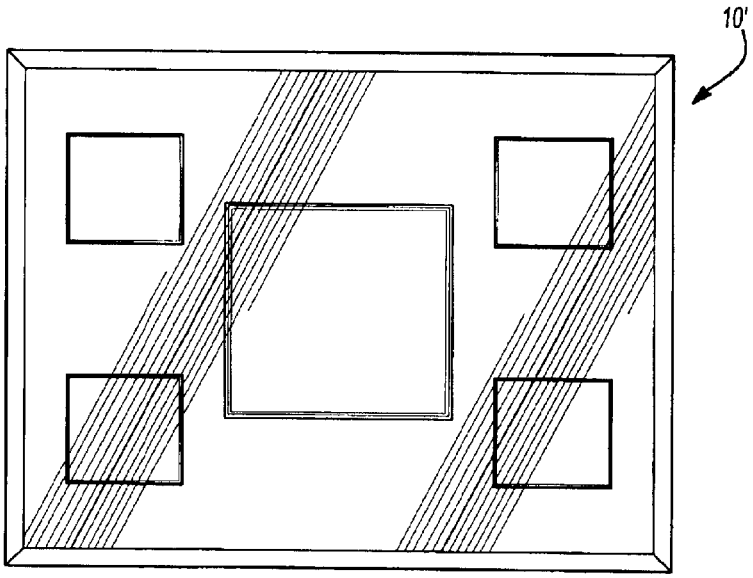
FIG. 5 is a view similar to FIG. 4 but illustrating a modification thereof.

A front view of the completed display device is illustrated in FIG. 4 in which the various articles to be displayed are positioned by the article holder 22 in alignment with their associated cutouts in the mat 18. A typical modification of the display device 10' is illustrated in FIG. 5 in which both the mat and article holder have cutouts and pockets at multiple different positions.

From the foregoing, it can be seen that the present invention provides a simple and yet highly effective display device for displaying planar articles. Furthermore, it has been found that the present invention is particularly useful for displaying sports memorabilia and the like.

Having described my invention, however, many modifications thereto will become apparent to those skilled in the art to which it pertains without deviation from the spirit of the invention as defined by the scope of the appended claims.

I claim:

1. A display device for displaying flat articles comprising:

a frame having a front side and a rear side, a transparent sheet mounted in said frame at said front side of said frame, a planar mat having a plurality of cutouts in predefined shapes and at predefined locations, said mat being positioned within said frame behind and in flat abutment with said mat, a planar article holder having a plurality of pockets, each said pocket corresponding in shape and location to an associated cutout in said transparent sheet, said article holder having at least one transparent side and being positioned in said frame so that each pocket is aligned with its associated cutout in said mat, a planar backing mounted in said frame adjacent said rear side of said frame so that said mat and said article holder are sandwiched between said sheet and said backing, wherein said article holder comprises a transparent material.

2. The invention as defined in claim 1 wherein said article holder comprises a plastic material.

3. The invention as defined in claim 1 wherein said backing has one side hingedly secured to said frame.

4. The invention as defined in claim 1 wherein said frame is made of metal or wood.

5. The invention as defined in claim 1 wherein said backing is constructed of a rigid material.

6. The invention as defined in claim 1 wherein said backing is constructed of a cardboard material.

7. The invention as defined in claim 1 wherein said mat is constructed of a rigid material.

8. The invention as defined in claim 7 wherein said mat is constructed of a cardboard material.

9. The invention as defined in claim 1 wherein said article holder comprises a vinyl material.

10. The invention as defined in claim 1 wherein said frame is made of wood.

11. A display device for displaying flat articles comprising:

a frame having a front side and a rear side, a transparent sheet mounted in said frame at said front side of said frame, a planar mat having a plurality of cutouts in predefined shapes and at predefined locations, said mat being positioned within said frame behind and in flat abutment with said mat, a planar article holder having a plurality of pockets, each said pocket corresponding in shape and location to an associated cutout in said mat, said article holder having at least one transparent side and being positioned in said frame so that each pocket is aligned with its associated cutout in said mat, a planar backing mounted in said frame adjacent said rear side of said frame so that said mat and said article holder are sandwiched between said sheet and said backing wherein said article holder comprises a transparent vinyl material.

12. The invention as defined in claim 11 wherein said article holder comprises a plastic material.

13. The invention as defined in claim 11 wherein said backing has one side hingedly secured to said frame.

14. The invention as defined in claim 11 wherein said frame is made of metal or wood.

15. The invention as defined in claim 11 wherein said backing is constructed of a rigid material.

16. The invention as defined in claim 11 wherein said backing is constructed of a cardboard material.

17. The invention as defined in claim 11 wherein said mat is constructed of a rigid material.

18. The invention as defined in claim 17 wherein said mat is constructed of a cardboard material.

19. The invention as defined in claim 11 wherein said article holder comprises a vinyl material.

* * * * *